US008845304B2

(12) United States Patent
Sugiyama et al.

(10) Patent No.: US 8,845,304 B2
(45) Date of Patent: Sep. 30, 2014

(54) MOTOR-DRIVEN COMPRESSOR

(75) Inventors: Tomohiko Sugiyama, Kariya (JP); Ken Suitou, Kariya (JP)

(73) Assignee: Kabushiki Kaisha Toyota Jidoshokki, Kariya-Shi (JP)

( * ) Notice: Subject to any disclaimer, the term of this patent is extended or adjusted under 35 U.S.C. 154(b) by 118 days.

(21) Appl. No.: 13/073,750

(22) Filed: Mar. 28, 2011

(65) Prior Publication Data

US 2011/0243765 A1 Oct. 6, 2011

(30) Foreign Application Priority Data

Mar. 31, 2010 (JP) ..... 2010-082933

(51) Int. Cl.
*F04B 39/14* (2006.01)
*F04B 53/22* (2006.01)
*F04B 35/04* (2006.01)

(52) U.S. Cl.
CPC ..... *F04B 35/04* (2013.01)
USPC ..... 417/360

(58) Field of Classification Search
USPC ..... 417/360, 361, 363; 248/562, 566, 634, 248/636
See application file for complete search history.

(56) References Cited

U.S. PATENT DOCUMENTS

| | | | | |
|---|---|---|---|---|
| 4,599,382 | A * | 7/1986 | Sato et al. | 525/139 |
| 4,938,448 | A * | 7/1990 | Shimazaki | 248/635 |
| 5,842,677 | A * | 12/1998 | Sweeney et al. | 248/635 |
| 6,233,140 | B1 * | 5/2001 | Cummings et al. | 361/679.55 |
| 6,258,422 | B1 * | 7/2001 | Motojima | 428/36.4 |
| 6,460,823 | B1 * | 10/2002 | Herder et al. | 248/637 |
| 6,565,329 | B2 * | 5/2003 | Yokomachi et al. | 417/269 |
| 6,715,746 | B2 * | 4/2004 | Bachmeyer et al. | 267/294 |
| 2009/0060754 | A1 * | 3/2009 | Matsumura | 417/205 |

FOREIGN PATENT DOCUMENTS

| | | | |
|---|---|---|---|
| CN | 101147003 | A | 3/2008 |
| JP | 63-65873 | U | 4/1988 |
| JP | 64-44812 | U | 3/1989 |
| JP | 64-44814 | U | 3/1989 |
| JP | 64-44815 | U | 3/1989 |
| JP | 11-309783 | A | 11/1999 |
| JP | 2000-130330 | A | 5/2000 |
| JP | 2005-220854 | A | 8/2005 |
| JP | 2005-220855 | A | 8/2005 |
| JP | 2005-220856 | A | 8/2005 |

OTHER PUBLICATIONS

Chinese Office Action with English Translation for Chinese Patent Application No. 201110083658.X mailed on Apr. 22, 2013.

* cited by examiner

*Primary Examiner* — Bryan Lettman
(74) *Attorney, Agent, or Firm* — Yoshida & Associates, LLC

(57) ABSTRACT

The motor-driven compressor is mounted on a mounting of a vehicle. The motor-driven compressor includes a compressor body, a mounting, a damper and a fastener. The compressor body is electrically powered to draw in fluid for compression and to discharge the compressed fluid. The mounting of the compressor is formed on the compressor body and has a mounting hole. The damper is made of a resin and receives therein the mounting of the compressor. The damper is interposed between the compressor body and the mounting of the vehicle and has a through hole. The fastener is inserted through the through hole of the damper and the mounting hole of the compressor for securing the damper to the mounting of the vehicle.

4 Claims, 5 Drawing Sheets

MOTOR-DRIVEN COMPRESSOR

BACKGROUND OF THE INVENTION

The present invention relates to a motor-driven compressor and more particularly to a motor-driven compressor mounted on a vehicle.

Hybrid vehicle that is powered by both engine and electric motor varies the ratio of engine drive to motor drive in accordance with the running condition of the vehicle. In such a hybrid vehicle, if a compressor that operates a refrigeration cycle of an air conditioner is driven by the engine of the vehicle, the compressor cannot obtain necessary drive force constantly from the engine. In a hybrid vehicle, therefore, a compressor that is driven by electric power from a battery mounted on the vehicle is used. Such a motor-driven compressor is mounted on the body or engine of the vehicle.

The compressor is driven only by the electric motor when the engine is at a stop, such as during an idle stop. When the motor-driven compressor is driven with the engine at a stop, noise is developed due to the operation of the motor-driven compressor. Main cause of the noise development is the resonance due to the vibration of the body or engine caused by the vibration of the motor-driven compressor transmitted via its mounting rather than the sound radiated from the motor-driven compressor. Various mountings for a motor-driven compressor have been proposed to reduce the vibration transmission from the compressor to the body or engine of the vehicle.

Japanese Unexamined Utility Model Application Publication No. 64-44814 discloses a structure for mounting a compressor to an engine block or to mounting brackets of the engine by screws that are inserted through holes of the respective mountings formed integrally with the compressor and screwed into the threaded holes in the mounting brackets of the engine block. Two mountings are provided for each screw and each mounting has a rubber bushing press-fitted in the hole. Each rubber bushing has an outer cylindrical shell, an inner cylindrical shell and a rubber vibration isolator adhered between the outer and inner cylindrical shells. In addition, a spacer having the same inside diameter as the inner cylindrical shell is interposed between the two rubber bushings. Each screw is inserted through the first rubber bushing, the spacer and the second rubber bushing in this order and screwed into the threaded hole in the mounting bracket of the engine block. With the screw thus screwed in the threaded hole, the spacer prevents the first rubber bushing that is adjacent to the head of the screw from being deformed.

The structure in the above-referenced publication uses a large number of parts for mounting the compressor on the mounting brackets of the engine block and hence requires an extra assembling process for mounting the compressor to the mounting brackets of the engine block, thus increasing the manufacturing cost of the compressor. In addition, if the screw comes in contact with one end of the spacer in inserting the screw through the spacer, the screw may fail to be successfully inserted through the spacer. Therefore, it takes trouble to successfully insert the screw through the spacer, thereby increasing the manufacturing cost.

The present invention is directed to a motor-driven compressor which reduces the cost for mounting the compressor to an engine while reducing the noise development.

SUMMARY OF THE INVENTION

In accordance with an aspect of the present invention, the motor-driven compressor is mounted on a mounting of a vehicle. The motor-driven compressor includes a compressor body, a mounting, a damper and a fastener. The compressor body is electrically powered to draw in fluid for compression and to discharge the compressed fluid. The mounting of the compressor is formed on the compressor body and has a mounting hole. The damper is made of a resin and receives therein the mounting of the compressor. The damper is interposed between the compressor body and the mounting of the vehicle and has a through hole. The fastener is inserted through the through hole of the damper and the mounting hole of the compressor for securing the damper to the mounting of the vehicle.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE EMBODIMENTS

The following will describe the embodiments of the present invention with reference to the accompanying drawings. The motor-driven compressor 101 according to the first embodiment of the present invention will be described with reference to FIGS. 1 through 3.

Figure 1:
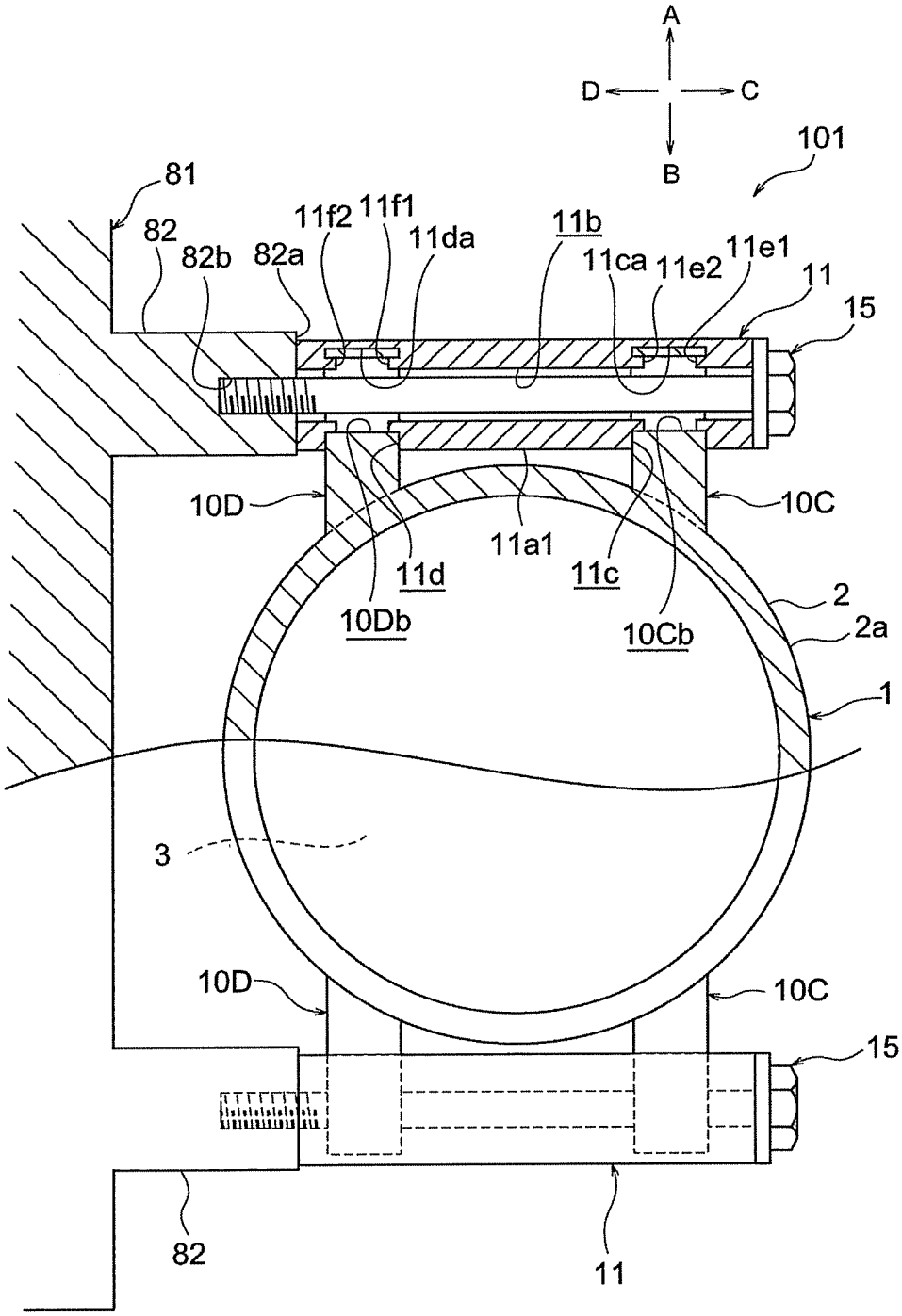
FIG. 1 is a schematic side view showing a motor-driven compressor according to a first embodiment of the present invention.

Referring to FIG. 1 showing the motor-driven compressor 101 in schematic view, it is mounted on an internal combustion engine 81 installed in a vehicle. The motor-driven compressor 101 includes a compressor body 1 having a substantially cylindrical housing 2 and a fluid compression mechanism 3 covered by the housing 2. The housing 2 is made of a metal such as aluminum alloy. The fluid compression mechanism 3 is electrically powered, and draws in fluid such as refrigerant for compression and discharges the compressed fluid. For the sake of convenience of explanation, the direction from the bottom to the top on each drawing is referred to as upward direction A, the direction from the top to the bottom is referred to as downward direction B, the direction from the left to the right is referred to as rightward direction C, and the direction from the right to the left is referred to as leftward direction D. In addition, the direction from the near side to the far side of each drawing which is perpendicular to the directions A, B, C and D is referred to as rearward direction F and the direction opposite to the rearward direction F is referred to as forward direction E.

The compressor body 1 has a pair of first mountings 10C projecting upward and downward from the outer circumferential surface 2*a* of the housing 2, respectively, as shown in FIG. 1. Similarly, the compressor body 1 has a pair of second mountings 10D projecting upward and downward from the outer circumferential surface 2*a* of the housing 2, respectively, as shown in FIG. 1. Each of the first and second mountings 10C and 10D has a shape of a rectangular parallelepiped, is made of the same material as the housing 2 and formed integrally with the housing 2. The paired first mountings 10C and the paired second mountings 10D serve as the mounting of the compressor of the present invention.

The motor-driven compressor 101 includes a pair of dampers 11 each having a shape of a rectangular parallelepiped. Each damper 11 is mounted to its corresponding first and second mounting 10C and 10D and made of a resin. The paired dampers 11 serve as the damper of the present invention.

The damper 11 is made of a resin having a high vibration damping performance and a high rigidity. The resin of the damper 11 has a bending elastic modulus of not less than 100 MPa and not more than 10000 MPa. The resin of the damper 11 includes PP (polypropylene), PBT (polybutylene terephthalate or PBT resin), PVC (vinyl chloride resin or polyvinyl chloride), PUR (polyurethane), PTFE (fluororesin), PF (phenolic resin), PC (polycarbonate), PA (polyamide or nylon), ABS (acrylonitrile butadiene styrene or ABS resin), carbonaceous resin and any combinations of these materials. The resin of the damper 11 also includes fiber-reinforced plastic (FRP).

The loss factor of the resin of the damper 11 that represents the vibration damping performance is greater than that of the metal which forms the first and second mountings 10C and 10D. The loss factor preferably ranges between 0.01 and 1. Incidentally, the loss factor of aluminum alloy that metal forms the first and second mountings 10C and 10D is 0.0001.

Figure 2:
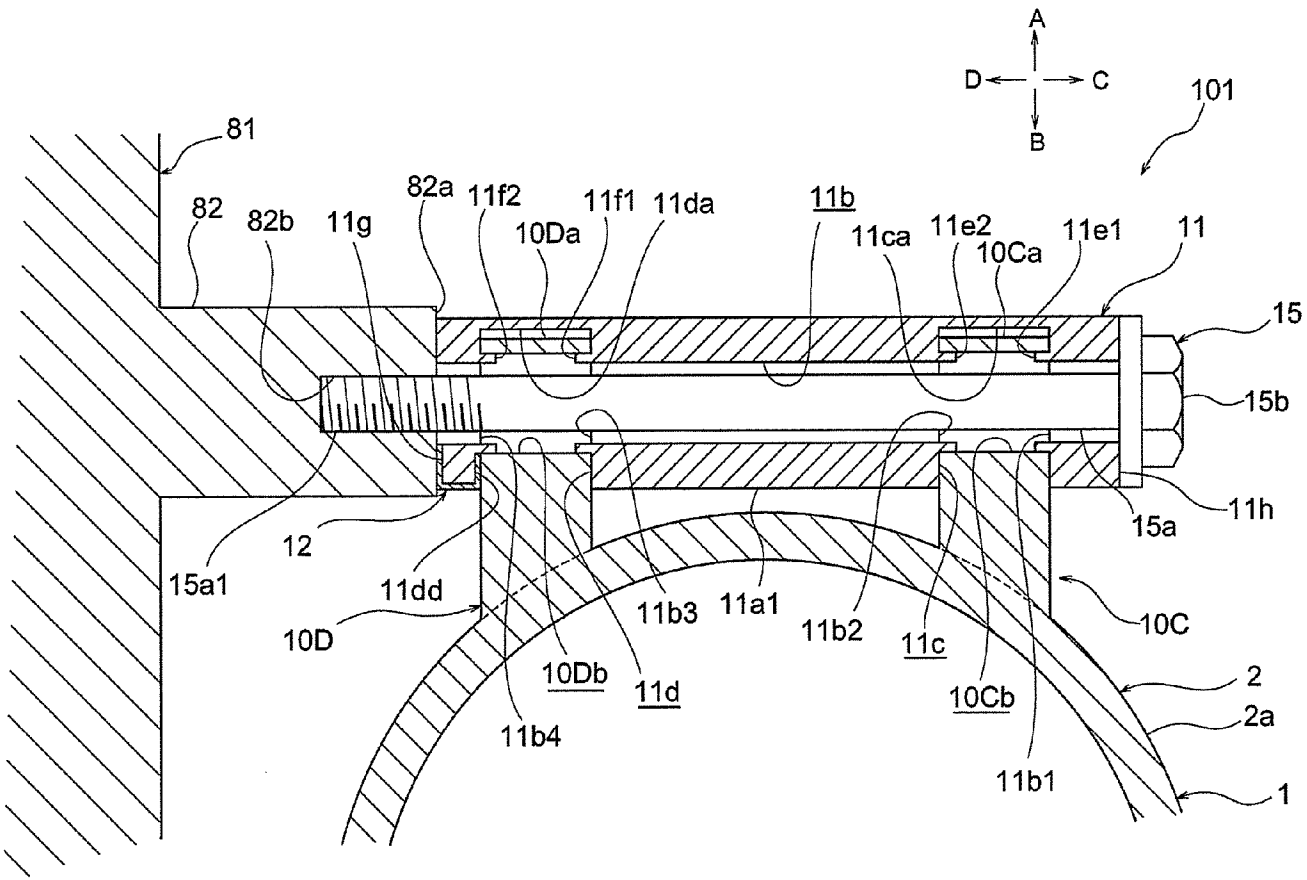
FIG. 2 is a partially sectional side view showing the motor-driven compressor of FIG. 1 and its related parts.
Figure 3:
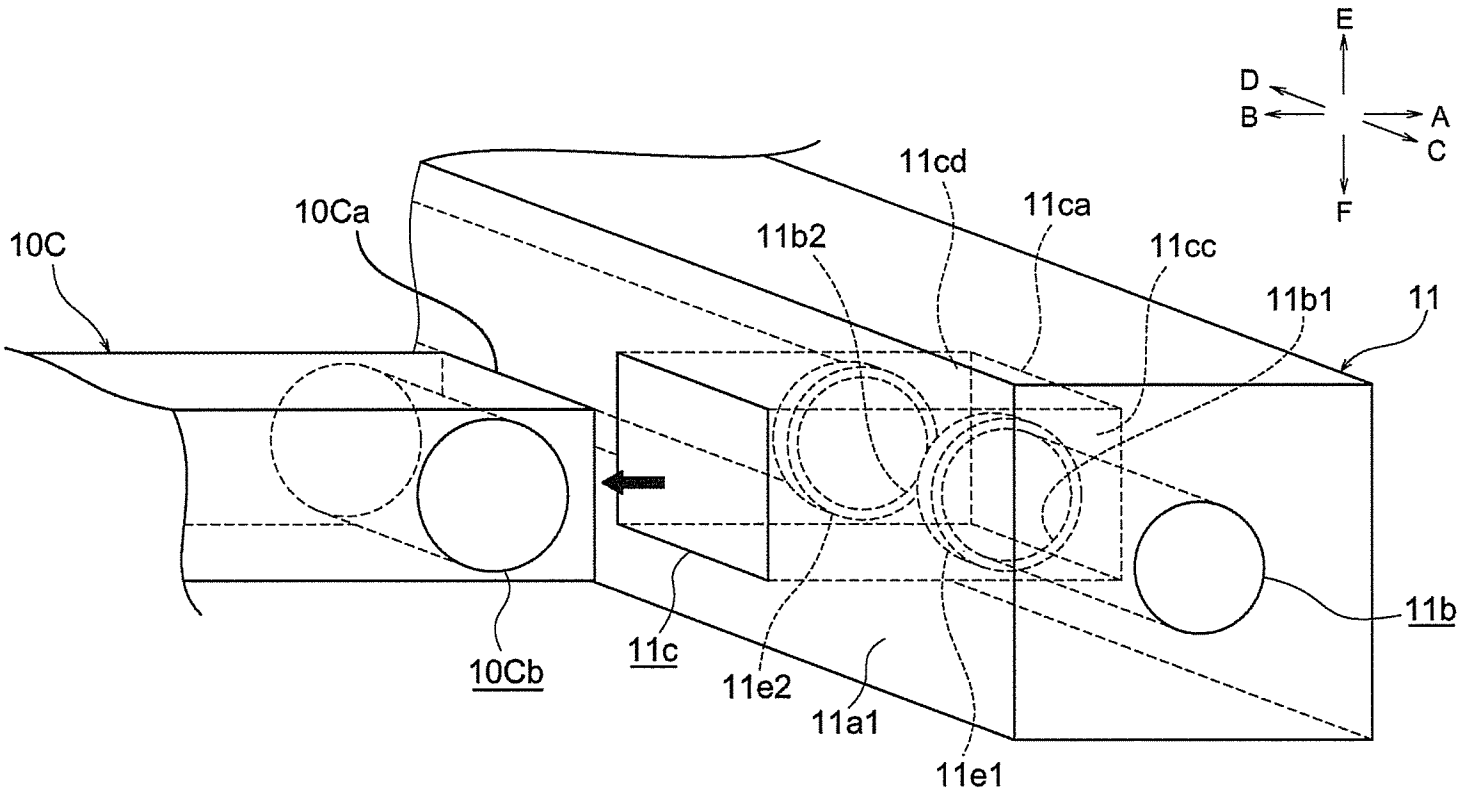
FIG. 3 is a perspective view showing a first mounting of the motor-driven compressor of FIG. 2 and a damper.

The following will describe the first mounting 10C, the second mounting 10D and the damper 11 in detail with reference to FIGS. 2 and 3. The damper 11 has therethrough in the longitudinal direction thereof a hole 11*b*. The damper 11 also has therein a first insertion hole 11*c* and a second insertion hole 11*d* each extending from the bottom of the outer surface 11*a*1 of the damper 11 through the through hole 11*b* for communication therewith. The through holes 11*b* of the dampers 11 serve as the through hole of the present invention. Each through hole 11*b* has a round shape in cross section. Each of the first insertion hole 11*c* and the second insertion hole 11*d* has a rectangular shape in cross section. The first insertion hole 11*c* and the second insertion hole 11*d* are formed to receive therein the first mounting 10C and the second mounting 10D, respectively. The first insertion hole 11*c* and the second insertion hole 11*d* extend perpendicularly to the through hole 11*b* to the innermost 11*ca* of the first insertion hole 11*c* and the innermost 11*da* of the second insertion hole 11*d*, respectively, that recede upward from the inner peripheral surface of the through hole 11*b*.

Referring to FIG. 3, the through hole 11*b* communicates at the inner surface 11*cc* on the right side as viewed in FIG. 1 of the first insertion hole 11*c* with the first insertion hole 11*c* to form the opening 11*b*1 in the inner surface 11*cc*. The through hole 11*b* also communicates at the inner surface 11*cd* on the left side as viewed in FIG. 1 of the first insertion hole 11*c* with the first insertion hole 11*c* to form the opening 11*b*2 in the inner surface 11*cd*. An annular projection 11*e*1 is formed projecting from the inner surface 11*cc* of the first insertion hole 11*c* and surrounding the opening 11*b*1. An annular projection 11*e*2 is also formed projecting from the inner surface 11*cd* of the first insertion hole 11*c* and surrounding the opening 11*b*2. The second insertion hole 11*d* has openings 11*b*3, 11*b*4 and annular projections 11*f*1, 11*f*2 as in the case of the first insertion hole 11*c* (refer to FIG. 2). A pair of the projections 11*e*1, 11*e*2, 11*f*1 and 11*f*2 serves as the projection of the present invention.

Referring back to FIG. 1, the first mounting 10C and the second mounting 10D of the compressor body 1 have therethrough a first mounting hole 10Cb and a second mounting hole 10Db extending in the longitudinal direction of the damper 11, respectively. Each of the first mounting hole 10Cb and the second mounting hole 10Db has a round shape in cross section. The axial direction of the first mounting hole 10Cb and the second mounting hole 10Db is perpendicular to the axial direction of the housing 2. A pair of the first mounting holes 10Cb and a pair of the second mounting holes 10Db serve as the mounting hole of the present invention. Referring to FIG. 3, the first mounting hole 10Cb of the first mounting 10C is formed so that the inner peripheral surfaces at the opposite ends of the first mounting hole 10Cb are fittingly engageable with the outer peripheral surfaces of the projections 11*e*1 and 11*e*2, respectively. The same is true of the second mounting hole 10Db of the second mounting 10D and the projections 11*f*1 and 11*f*2 (Refer to FIG. 2).

Referring to FIG. 2, the damper 11 has a metal film 12 that extends continuously on the left end surface 11*g* of the damper 11, the outer surface 11*a*1 of the damper 11 located on the left side of the second insertion hole 11*d*, and the inner surface 11*dd* of the damper 11 located on the left side of the second insertion hole 11*d*. The metal film 12 is made of an electrically conductive metal. The metal film 12 is preferably formed with a thickness of about 0.1 mm to about 0.5 mm so as to have flexibility and low rigidity. The metal film 12 is formed integrally with the damper 11 by resin molding such as insert molding. The metal films 12 serve as the conductor of the present invention.

The damper 11 is mounted to the compressor body 1 by inserting the first mounting 10C and the second mounting 10D of the compressor body 1 into the first insertion hole 11*c* and the second insertion hole 11*d*, respectively. Referring to FIGS. 2 and 3, pressing the damper 11 against the first mounting 10C inserted in the first insertion hole 11*c*, the projections 11*e*1 and 11*e*2 of the damper 11 are moved past the distal end 10Ca of the first mounting 10C to be fitted in the first mounting hole 10Cb of the first mounting 10C. Pressing the damper 11 against the second mounting 10D inserted in the second insertion hole 11*d*, the projections 11*f*1 and 11*f*2 of the damper 11 are moved past the distal end 10Da of the second mounting 10D to be fitted in the second mounting hole 10Db of the second mounting 10D. Thus, the damper 11 is fixed to the first mounting 10C and the second mounting 10D.

With the damper 11 thus fixed to the first mounting 10C and the second mounting 10D, the damper 11 encloses the end portions of the first mounting 10C and the second mounting 10D. The first mounting 10C and the second mounting 10D are surrounded by and in contact with the damper 11. However, the distal end 10Ca of the first mounting 10C is spaced away from and hence free of contact with the innermost 11*ca* of the first insertion hole 11*c*. The distal end 10Da of the second mounting 10D is also spaced away from and hence free of contact with the innermost 11*da* of the second insertion hole 11*d*. The damper 11 is positioned properly with respect to the first mounting 10C and the second mounting 10D by the fitting of the projections 11*e*1, 11*e*2 and 11*f*1, 11*f*2 with the first mounting 10C and the second mounting 10D, respectively. The second mounting 10D is in contact at the second insertion hole 11*d* with the metal film 12, so that the housing 2 of the compressor body 1 is electrically connected to the metal film 12.

Referring back to FIG. 1, the engine 81, which is installed in the vehicle and on which the motor-driven compressor 101 is mounted, is formed with cylindrical mountings 82 to which the motor-driven compressor 101 is mounted. Each mounting 82 has at the right end thereof a mounting surface 82*a* and therein an internally threaded hole 82*b*. The mountings 82 serve as the mounting of the vehicle of the present invention.

The motor-driven compressor 101 is mounted on the engine 81 by fixing the dampers 11 to the mountings 82. Referring to FIG. 2, in fixing the damper 11 to the mounting 82, with the left end surface 11*g* of the damper 11 set in contact with the mounting surface 82*a* of the mounting 82, a fastener 15 such as a screw having on the shank 15*a* thereof an external thread 15*a*1 is inserted through the through hole 11*b* of the damper 11. With the shank 15*a* of the fastener 15 inserted through the through hole 11*b*, the first mounting hole 10Cb of the first mounting 10C and the second mounting hole 10Db of the second mounting 10D, the external thread 15*a*1 of the fastener 15 is screwed into the internally threaded hole 82*b* of the mounting 82 thereby to fasten the damper 11 to the mounting 82. Thus, the motor-driven compressor 101 is fixed to the mounting 82. A pair of the fasteners 15 serves as the fastener of the present invention.

The fastener 15 is made of a metal. The first mounting hole 10Cb of the first mounting 10C and the second mounting hole 10Db of the second mounting 10D are larger in diameter than the shank 15*a* of the fastener 15 so that the inner peripheral surfaces of the first and second mounting holes 10Cb, 10Db are spaced away from the shank 15*a*.

With the motor-driven compressor 101 fixed to the mounting 82, the right end surface 11*h* of the damper 11 is in contact with the head 15*b* of the fastener 15 and, the left end surface 11*g* of the damper 11 is in contact with the mounting surface 82*a* of the mounting 82 and partially with the metal film 12 that is in contact with the mounting surface 82*a*. In addition, the first mounting 10C is in contact at the right and left surfaces thereof with the damper 11, and the second mounting 10D is in contact at the right and left surfaces thereof with the damper 11 and partially with the metal film 12 that is in contact with the damper 11. The damper 11, the first mounting 10C and the second mounting 10D support the fastening force of the fastener 15.

The damper 11 is fixed to the first mounting 10C by fitting the outer peripheries of the projections 11*e*1 and 11*e*2 into the first mounting hole 10Cb. Similarly, the damper 11 is fixed to the second mounting 10D by fitting the outer peripheries of the projections 11*f*1 and 11*f*2 into the second mounting hole 10Db. The openings 11*b*1 and 11*b*2 that are radially inward of the projections 11*e*1 and 11*e*2 of the damper 11 are smaller in diameter than the first mounting hole 10Cb, and the through hole 11*b* communicating with the openings 11*b*1 and 11*b*2 is also smaller in diameter than the first mounting hole 10Cb. The same is true of the openings 11*b*3 and 11*b*4, the second mounting hole 10Db and the through hole 11*b*.

Thus, the shank 15*a* of the fastener 15 is insertable through the openings 11*b*1 and 11*b*2 that are radially inward of the projections 11*e*1 and 11*e*2 that are radially inward of the first mounting hole 10Cb. Therefore, the movement of the shank 15*a* in the radial direction is restricted by the projections 11*e*1 and 11*e*2 and the through hole 11*b*. Thus, the shank 15*a* is free of contact with the first mounting 10C. In a similar manner, the shank 15*a* of the fastener 15 is insertable through the openings 11*b*3 and 11*b*4 that are radially inward of the projections 11*f*1 and 11*f*2 that are radially inward of the second mounting hole 10Db. Therefore, the movement of the shank 15*a* in the radial direction is restricted by the projections 11*f*1 and 11*f*2 and the through hole 11*b*. Thus, the shank 15*a* is free of contact with the second mounting 10D.

Although the first mounting 10C and the second mounting 10D are in contact with the damper 11, the first mounting 100 and, the second mounting 10D are free of contact with the shank 15*a* of the fastener 15. Since the damper 11 is interposed between the first mounting 10C and the head 15*b* of the fastener 15 and between the second mounting 10D and the mounting 82, the first mounting 10C and the second mounting 10D are kept free of contact with the fastener 15 and the mounting 82. The second mounting 10D is electrically connected to the mounting 82 of the engine 81 via the metal film 12. Therefore, the housing 2 of the compressor body 1 is electrically connected to the engine 81 via the metal film 12.

The following will describe the operation of the motor-driven compressor 101 of the present embodiment with reference to FIGS. 1 through 3. Referring to FIG. 1, when the motor-driven compressor 101 is started, the fluid compression mechanism 3 covered by the housing 2 is operated. During the compressor operation, the housing 2 is vibrated.

Referring to FIG. 1 together with FIG. 2, the vibration of the housing 2 is transmitted to the damper 11 via the first mounting 10C and the second mounting 10D without being transmitted to the fastener 15 which is free of contact with the first mounting 10C and the second mounting 10D. Thus, the vibration of the housing 2 is dampened in the damper 11 having a high vibration damping performance. The vibration of the housing 2 is also transmitted to the metal film 12 via the second mounting 10D. Because the metal film 12 has a small thickness and low rigidity, the vibration transmitted to the metal film 12 is further transmitted to the damper 11 and dampened in the damper 11. Thus, the vibration of the housing 2 is hard to be transmitted to the mounting 82 and hence to the engine 81 and the body of the vehicle via the engine 81.

The damper 11 which is made of a highly rigid resin having a bending elastic modulus not less than 100 MPa and not more than 10000 MPa is not deformed by the vibration of the housing 2, the first mounting 10C and the second mounting 10D and, therefore, the housing 2, the first mounting 10C and the second mounting 10D are not displaced. Thus, the amplitude of the vibration of the housing 2 is prevented from increasing. Since the distal end 10Ca of the first mounting 10C and the distal end 10Da of the second mounting 10D are free of contact with the damper 11, no sound development occurs due to contact between the distal ends 10Ca, 10Da of the vibrating mountings 10C, 10D and the damper 11.

Any electric charge generated in the housing 2 by the fluid compression mechanism 3 is allowed to flow to the metal film 12 via the second mounting 10D. The electric charge flowing through the metal film 12 then flows to the engine 81 via the mounting 82 and further to the body of the vehicle through the engine 81. Thus, the metal films 12 serve to ground the motor-driven compressor 101.

As described above, the motor-driven compressor 101 of the first embodiment is mounted to a pair of the mountings 82 of the engine 81. The motor-driven compressor 101 includes the compressor body 1, a pair of the first mountings 10C, a pair of the second mountings 10D, a pair of the dampers 11 and a pair of the fasteners 15. The compressor body 1 is electrically powered to draw in fluid for compression and to discharge the compressed fluid. Each of the paired first mountings 10C is formed on the compressor body 1 and has a first mounting hole 10Cb. Each of the paired second mountings 10D is formed on the compressor body 1 and has a second mounting hole 10Db. Each of the paired dampers 11 is made of a resin and receives therein the first and second mountings 10C, 10D. Each damper 11 is interposed between the compressor body 1 and the mounting 82 and has therethrough the through hole 11*b*. Each of the paired fasteners 15 is inserted in the mounting 82 through the through hole 11*b* of the damper 11, the first mounting hole 10Cb of the first mounting 10C and the second mounting hole 10Db of the second mounting 10D for securing the damper 11 to the mounting 82.

Thus, the vibration developed by the compressor body 1 is transmitted to the damper 11 via the first mounting 10C and the second mounting 10D without being transmitted directly to the mounting 82. The vibration transmitted to the damper 11 is dampened by the damper 11 which is made of a resin and has a high vibration damping performance. Thus, the vibration transmission from the compressor body 1 to the mounting 82 is reduced. Therefore, the vibration transmission from the motor-driven compressor 101 to the engine 81 is reduced, and the vibration transmission to the vehicle having the engine 81 is also reduced. Consequently, resonance of the vehicle is reduced. The damper 11 is mounted to the first mounting 10C and the second mounting 10D so as to enclose the end portions of the first mounting 10C and the second mounting 10D. This makes it easy to mount the damper 11 to the first mounting 10C and the second mounting 10D, thereby reducing the cost for mounting the motor-driven compressor 101 to the engine 81.

The first mounting hole 10Cb of the first mounting 10C and the second mounting hole 10Db of the second mounting 10D are larger in diameter than the fastener 15 inserted through the first mounting hole 10Cb and the second mounting hole 10Db, so that the fastener 15 is inserted through the through hole 11*b* of the damper 11, the first mounting hole 10Cb of the first mounting 10C and the second mounting hole 10Db of the second mounting 10D without being in contact with the first mounting 10C and the second mounting 10D for securing the damper 11 to the mounting 82. Since the fastener 15 is free of contact with the first mounting 10C and the second mounting 10D, the vibration generated by the compressor body 1 is hard to be transmitted to the mounting 82 via the first mounting 10C, the second mounting 10D and the fastener 15. Thus, the fastener 15 may be made of a metal which can transmit the vibration, so that the fastening force of the fastener 15 is increased and, therefore, the strength of mounting the motor-driven compressor 101 to the mounting 82 is also increased.

The damper 11 is fixed to the first mounting 10C by fitting the outer peripheries of the projections 11*e*1 and 11*e*2 of the damper 11 into the first mounting hole 10Cb. The damper 11 is fixed to the second mounting 10D by fitting the outer peripheries of the projections 11*f*1 and 11*f*2 of the damper 11 into the second mounting hole 10Db. The openings 11*b*1 and 11*b*2 that are radially inward of the projections 11*e*1 and 11*e*2 of the damper 11 are smaller in diameter than the first mounting hole 10Cb, and the through hole 11*b* communicating with the openings 11*b*1 and 11*b*2 is also smaller in diameter than the first mounting hole 10Cb. The openings 11*b*3 and 11*b*4 that are radially inward of the projections 11*f*1 and 11*f*2 of the damper 11 are smaller in diameter than the second mounting hole 10Db, and the through hole 11*b* communicating with the openings 11*b*3 and 11*b*4 is also smaller in diameter than the second mounting hole 10Db. By so constructing, the fastener 15 is inserted positively through the through hole 11*b* of the damper 11, the first mounting hole 10Cb of the first mounting 10C and the second mounting hole 10Db of the second mounting 10D without being in contact with the first mounting 10C and the second mounting 10D, and a clearance between the fastener 15 and the first and second mountings 10C, 10D is maintained.

The damper 11 has the projections 11*e*1, 11*e*2 and 11*f*1, 11*f*2 that fittingly engage with the first mounting hole 10Cb of the first mounting 10C and the second mounting hole 10Db of the second mounting 10D, respectively, for fixing the first mounting 10C and the second mounting 10D to the damper 11. Thus, fixing the damper 11 to the first mounting 10C and the second mounting 10D can be accomplished with ease, which helps to reduce the cost for mounting the motor-driven compressor 101 to the engine 81.

The motor-driven compressor 101 further includes the metal film 12 formed integrally with the damper 11 for electrically connecting the second mounting 10D and the mounting 82. The metal film 12 is flexible and electrically conductive. The metal film 12 formed integrally with the damper 11 electrically connects the second mounting 10D and the mounting 82 thereby to electrically connect the compressor body 1 and the engine 81, so that the metal film 12 serves to ground the motor-driven compressor 101. The provision of such metal film 12 helps to reduce the manufacturing cost by facilitating the grounding the compressor 101.

In the motor-driven compressor 101 wherein the bending elastic modulus of the resin of the damper 11 is not less than 100 MPa and not more than 10000 MPa, the damper 11 is rigid enough to accomplish firm mounting of the damper 11 to the mounting 82, thus reducing the displacement of the compressor body 1, which prevents the amplitude of the vibration of the compressor body 1 from increasing. Therefore, the vibration transmission from the motor-driven compressor 101 to the engine 81 is further reduced.

In the motor-driven compressor 101 wherein the damper 11, the metal first mounting 10C and the metal second mounting 10D are integrated to form a compressor support and then fastened to the mounting 82 of the engine 81 by the fastener 15, the strength of mounting the compressor support is enhanced as compared to the case where the damper 11, the first mounting and the second mounting are made of a resin.

The damper 11 is fixed at the projections 11*e*1, 11*e*2 and 11*f*1, 11*f*2 to the first and second mounting holes 10Cb and 10Db of the first and second mountings 10C and 10D, respectively. That is, the damper 11 is fixed to the first and second mountings 10C and 10D in such a way that the first and second mountings 10C and 10D are held by and between the projections 11*e*1, 11*e*2 and 11*f*1, 11*f*2, respectively. Even if the end of the external thread 15*a*1 of the shank 15*a* of the fastener 15 comes in contact with the projection 11*e*2 or 11*f*2 in the mounting hole 10Cb or 10Db in inserting the shank 15*a* through the first and second mounting holes 10Cb and 10Db, the damper 11 is prevented from being removed from the first and second mounting holes 10Cb and 10Db. Therefore, mounting of the motor-driven compressor 101 to the engine 81 is accomplished with efficiency.

The following will describe the motor-driven compressor according to the second embodiment of the present invention. The second embodiment differs from the first, embodiment in that a mounting corresponding to the first mounting 10C and the second mounting 10D of the first embodiment is provided. For the sake of convenience of explanation, like or same parts or elements in the second embodiment will be referred to by the same reference numerals as those which have been used in the first embodiment, and the description thereof will be omitted.

Figure 4:
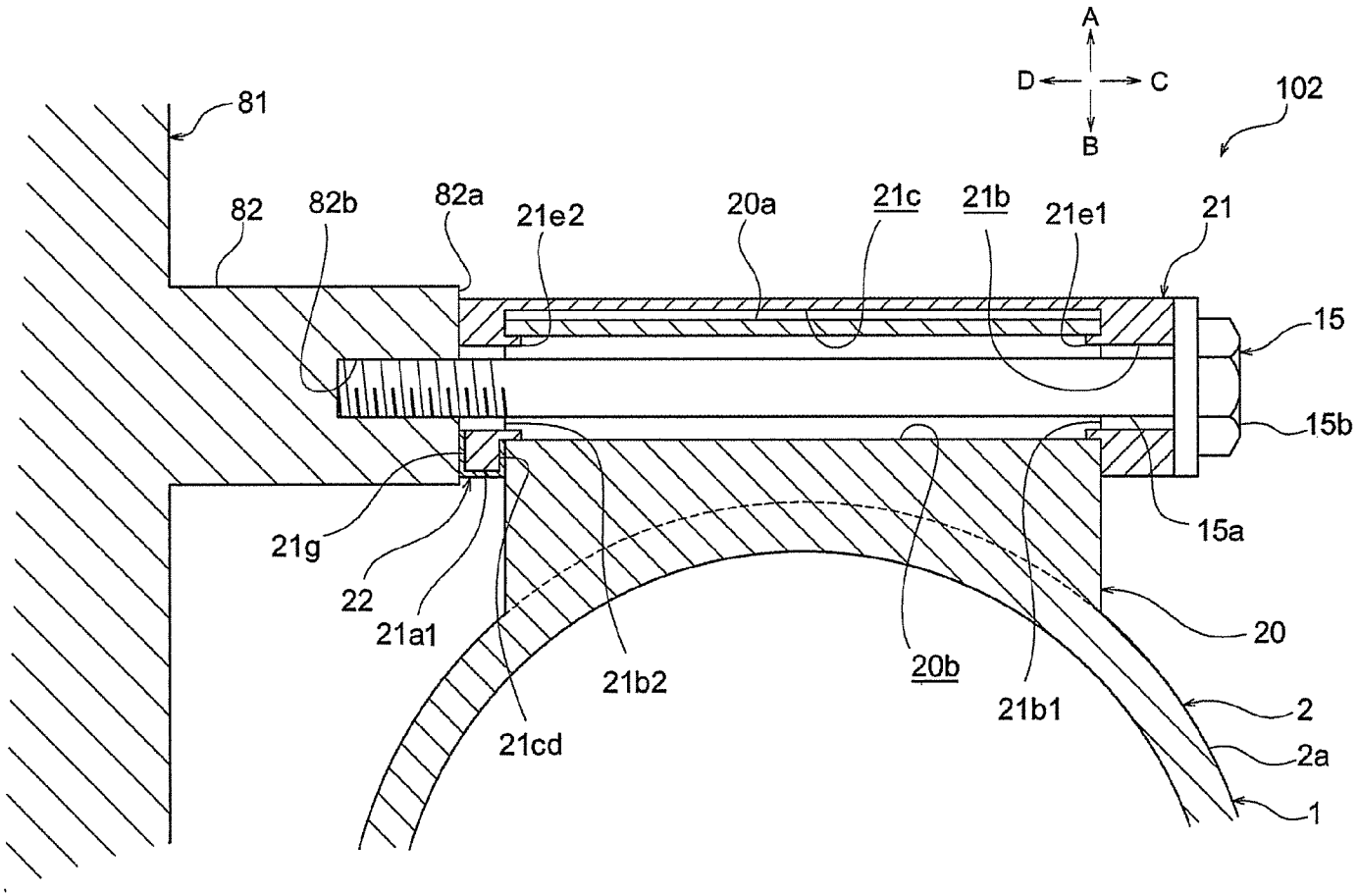
FIG. 4 is a partially sectional side view showing a motor-driven compressor according to a second embodiment of the present invention and its related parts.

Referring to FIG. 4 showing the motor-driven compressor 102 in sectional side view, the mounting 20 of the compressor 102 (only one mounting being shown in the drawing) is longer in the direction parallel to the axial direction of the damper 21 than the first mounting 10C and the second mounting 10D of the first embodiment. A pair of the mountings 20 serves as the mounting of the compressor of the present invention. The damper 21 is mounted to each mounting 20. A pair of the dampers 21 serves as the damper of the present invention. As in the case of the damper 11 of the first embodiment, the damper 21 has therethrough in the longitudinal direction thereof a hole 21*b* having a round shape in cross section. The through holes 21*b* of a pair of the dampers 21 serve as the through hole of the present invention. The damper 21 also has an insertion hole 21*c* communicating with the through hole 21*b*. The insertion hole 21*c* has a rectangular shape in cross section. The damper 21 has annular projections 21*e*1 and 21*e*2 projecting axially inward of the insertion hole 21*c* so as to surround the openings 21*b*1 and 21*b*2 of the through hole 21*b*, respectively. A pair of the projections 21*e*1 and 21*e*2 serves as the projection of the present invention.

The mounting 20 has therethrough a mounting hole 20*b* extending in the axial direction of the damper 20. The mounting hole 20*b* is formed so that the inner peripheral surfaces at the opposite ends thereof are fittingly engageable with the outer peripheral surfaces of the projections 21*e*1 and 21*e*2 of the damper 21, respectively. A pair of the mounting holes 20*b* serves as the mounting hole of the present invention. A metal film 22 is formed integrally with the damper 21 so as to extend continuously on the left end surface 21*g* of the damper 21, the outer surface 21*a*1 of the damper 21 located on the left side of the mounting 20, and the inner surface 21*cd* of the damper 21 located on the left side of the mounting 20. The metal films 22 serve as the conductor of the present invention.

When the damper 21 is pressed against the mounting 20 with the mounting 20 inserted in the insertion hole 21*c*, the projections 21*e*1 and 21*e*2 of the damper 21 are moved past the distal end 20*a* of the mounting 20 and fitted in the mounting hole 20*b* of the mounting 20. Thus, the damper 21 is fixed to the mounting 20. To fix the damper 21 to the mounting 82, the fastener 15 is inserted through the through hole 21*b* of the damper 21 and the mounting hole 20*b* of the mounting 20 and then screwed into the internally threaded hole 82*b* of the mounting 82. Thus, the motor-driven compressor 102 is fixed to the mounting 82.

With the motor-driven compressor 102 thus fixed to the mounting 82, the damper 21 is in contact at the right end surface thereof with the head 15*b* of the fastener 15 and at the left end surface thereof with the mounting surface 82*a* of the mounting 82 and partially with the metal film 22 that is in contact with the mounting surface 82*a*. In addition, the insertion hole 21*c* of the damper 21 is in contact at the right and left surfaces thereof with the mounting 20. The damper 21 and the mounting 20 support the fastening force of the fastener 15.

The mounting hole 20*b* of the mounting 20 is larger in diameter than the shank 15*a* of the fastener 15 so that the inner peripheral surface of the mounting hole 20*b* is spaced away from the shank 15*a*. The damper 21 is fixed to the mounting 20 by fitting the outer peripheries of the projections 21*e*1 and 21*e*2 into the mounting hole 20*b*. The openings 21*b*1 and 21*b*2 that are formed radially inward of the projections 21*e*1 and 21*e*2 of the damper 21 are smaller in diameter than the mounting hole 20*b*, and the through hole 21*b* communicating with the openings 21*b*1 and 21*b*2 is also smaller in diameter than the mounting hole 20*b*.

Thus, the shank 15*a* of the fastener 15 is insertable through the openings 21*b*1 and 21*b*2 that are radially inward of the projections 21*e*1 and 21*e*2 that are radially inward of the mounting hole 20*b*. Therefore, the movement of the shank 15*a* in the radial direction is restricted by the projections 21*e*1 and 21*e*2 and the through hole 21*b*. Thus, the shank 15*a* is free of contact with the mounting 20. Although the mounting 20 is surrounded by and in contact with the damper 21, the mounting 20 is free of contact with the shank 15*a* of the fastener 15. In addition, the damper 21 interposed between the mounting 20 and the head 15*b* of the fastener 15 and also between the mounting 20 and the mounting 82 keeps the mounting 20 free from contact with the fastener 15 and the mounting 82. The distal end 20*a* of the mounting 20 is spaced away from the innermost of the insertion hole 21*c*.

The mounting 20 is electrically connected to the mounting 82 of the engine 81 via the metal film 22. Therefore, the housing 2 of the compressor body 1 is electrically connected to the engine 81 via the metal film 12, which serves to ground the motor-driven compressor 102.

Part of the vibration of the housing 2 is transmitted to the damper 21 via the mounting 20 and the metal film 22 having a low rigidity and a small thickness without being transmitted to the fastener 15 that is free of contact with the mounting 20. The other vibration of the housing 2 is transmitted directly to damper 21. The vibration thus transmitted to the damper 21 is dampened in the damper 21. Thus, the vibration of the housing 2 is restricted from being transmitted to the mounting 82 and hence to the engine 81 and the body of the vehicle via the engine 81. The rest of the structure and the operation of the motor-driven compressor 102 according to the second embodiment is the same as that of the motor-driven compressor 101 according to the first embodiment and the description of such structure and operation will be omitted.

The motor-driven compressor 102 of the second embodiment offers substantially the same effects as the motor-driven compressor 101 of the first embodiment. In the motor-driven compressor 102 wherein the mounting 20 is longer in the axial direction of the damper 21 than the first mounting 10C and the second mounting 10D of the first embodiment, the strength of the mounting 20 is increased. Therefore, the strength of mounting the motor-driven compressor 102 to the mounting 82 is increased as compared to the case of the first embodiment.

The damper 21 is fixed at the projections 21*e*1 and 21*e*2 thereof to the mounting 20. That is, the damper 21 is fixed to the mounting 20 in such a way that the mounting 20 is held by and between the projections 21*e*1 and 21*e*2. Even if the end of the external thread 15*a*1 of the shank 15*a* of the fastener 15 comes in contact with the projection 21*e*2 in the mounting hole 20*b* in inserting the shank 15*a* through the mounting hole 20*b*, the damper 21 is prevented from being removed from the mounting hole 20*b*. Therefore, mounting of the motor-driven compressor 102 to the engine 81 is accomplished with efficiency.

The following will describe the motor-driven compressor according to the third embodiment of the present invention. The third embodiment differs from the first embodiment in that a first damper 31C and a second damper 31D corresponding the damper 11 of the first embodiment are mounted to the first mounting portion 30C and the second mounting portion 30D, respectively. For the sake of convenience of explanation, like or same parts or elements in the second embodiment will be referred to by the same reference numerals as those which have been used in the first embodiment, and the description thereof will be omitted.

Figure 5:
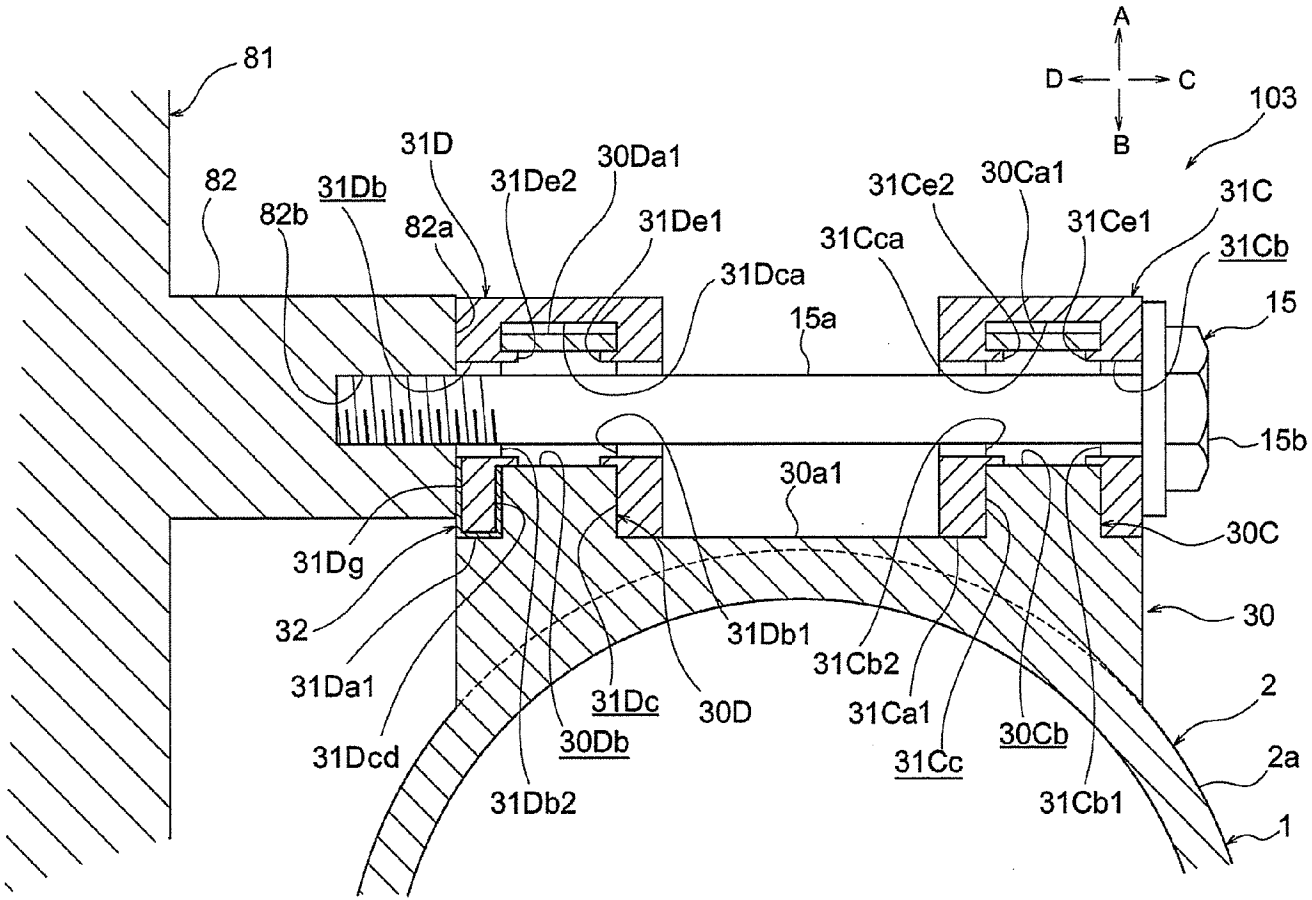
FIG. 5 is a partially sectional side view showing a motor-driven compressor according to a third embodiment of the present invention and its related parts.

Referring to FIG. 5 showing the motor-driven compressor 103 in sectional side view, the housing 2 is integrally formed with the mounting 30 (only one mounting being shown in the drawing) including the first mounting portion 30C and the second mounting portion 30D. The first mounting portion 30C and the second mounting portion 30D project upward from the outer surface 30*a*1 at the top of the mounting 30. A pair of the mountings 30 serves as the mounting of the compressor of the present invention.

The first damper 31C is mounted to the first mounting portion 30C. As in the case of the damper 11 of the first embodiment, the first damper 31C has therethrough a first hole 31Cb extending in the axial direction and having a round shape in cross section. The first damper 31C also has a first insertion hole 31Cc communicating with the first through hole 31Cb. The first insertion hole 31Cc has a rectangular shape in cross section. The first damper 31 has annular projections 31Ce1 and 31Ce2 projecting axially inward of the first insertion hole 31Cc so as to surround the openings 31Cb1 and 31Cb2 of the first through hole 31Cb, respectively. The second damper 31D is mounted to the second mounting portion 30D and formed as in first damper 31C. A pair of the first dampers 31C and a pair of the second dampers 310 serve as the damper of the present invention.

A metal film 32 is formed integrally with the second damper 31D so as to extend continuously on the left end surface 31Dg of the second damper 31D, the outer surface 31Da1 at the bottom of the second damper 310 located on the left side of the second insertion hole 31Dc, and the inner surface 31Dcd of the second damper 310 located on the left side of the second insertion hole 31Dc. The metal films 32 serve as the conductor of the present invention.

Pressing the first damper 31C against the first mounting portion 30C with the first mounting portion 30C inserted in the first insertion hole 31Cc, the projections 31Ce1 and 31Ce2 of the first damper 31C are moved past the distal end 30Ca1 of the first mounting portion 30C and fitted into the first mounting hole 30Cb of the first mounting portion 30C. Thus, the first damper 31C is fixed to the first mounting portion 30C. With the first damper 31C thus fitted in the first mounting hole 30Cb of the first mounting portion 30C, the first damper 31C is in contact at the outer surface 31Ca1 at the bottom thereof with the outer surface 30*a*1 at the top of the mounting 30. The second damper 31D is also fixed to the second mounting portion 30D as in the case of the first damper 31C. With the second damper 31D fixed to the second mounting portion 30D, the second damper 31D is in contact at the outer surface 31Da1 at the bottom thereof with the outer surface 30*a*1 at the top of the mounting 30.

To fix the first damper 31C and the second damper 31D to the mounting 82, the shank 15*a* of the fastener 15 is inserted through the first through hole 31Cb of the first damper 31, the first mounting hole 30Cb of the first mounting portion 30C and further through the second through hole 31Db of the second damper 31D and the second mounting hole 30Db of the second mounting portion 30D. Then, the external thread of the shank 15*a* is screwed into the internally threaded hole 82*b* of the mounting 82 thereby to fasten the first damper 31C and the second damper 31D to the mounting 82. Thus, the motor-driven compressor 103 is fixed to the mounting 82. A pair of the first mounting holes 30Cb and a pair of the second mounting holes 30Db serve as the mounting hole of the present invention. The through holes 31Cb of a pair of the first dampers 31C and the through holes 31Db of a pair of the second dampers 31D serve as the through hole of the present invention.

With the motor-driven compressor 103 fixed to the mounting 82, the first damper 31C is in contact at the axially outer surface thereof with the head 15*b* of the fastener 15 and at the opposite inner surfaces thereof with the first mounting portion 30C. In addition, the second damper 31D is in contact at the axially outer surface thereof with the mounting 82 and partially with the metal film 32 that is in contact with the mounting 82. The second damper 31D is in contact at the opposite inner surfaces thereof with the second mounting portion 30D and partially with the metal film 32 that is in contact with the second mounting portion 30D. Further, the first damper 31C is in contact with the outer surface 30*a*1 of the mounting 30. The second damper 31D is in contact with the outer surface 30*a*1 of the mounting 30 and partially with the metal film 32 that is in contact with the outer surface 30*a*1. The first damper 31C, the first mounting portion 30C, the second damper 31D and the second mounting portion 30D support the fastening force of the fastener 15.

The first mounting hole 30Cb of the first mounting portion 30C and the second mounting hole 30Db of the second mounting portion 30D are lager in diameter than the shank 15*a* of the fastener 15 so that the inner peripheral surfaces of the dampers 31C and 31D are spaced away from the shank 15*a*.

The first damper 31C is fixed to the first mounting portion 30C by fitting the outer peripheries of the projections 31Ce1 and 31Ce2 into the first mounting hole 30Cb. The openings 31Cb1 and 31Cb2 that are radially inward of the projections 31Ce1 and 31Ce2 of the first damper 31C are smaller in diameter than the first mounting hole 30Cb, and the first through hole 31Cb communicating with the openings 31Cb1 and 31Cb2 is also smaller in diameter than the first mounting hole 30Cb. The second damper 31D is fixed to the second mounting portion 30D by fitting the outer peripheries of the projections 31De1 and 31De2 into the second mounting hole 30Db. The openings 31Db1 and 31Db2 that are radially inward of the projections 31De1 and 31De2 of the second damper 31D are smaller in diameter than the second mounting hole 30Db, and the second through hole 31Db communicating with the openings 31Db1 and 31Db2 is also smaller in diameter than the second mounting hole 30Db. A pair of the projections 31Ce1, 31Ce2, 31De1 and 31De2 serves as the projection of the present invention.

Thus, the shank 15*a* of the fastener 15 is insertable through the openings 31Cb1 and 31Cb2 that are radially inward of the projections 31Ce1 and 31Ce2 that are radially inward of the first mounting hole 30Cb. Therefore, the movement of the shank 15*a* in the radial direction is restricted by the projections 31Ce1 and 31Ce2 and the first through hole 31Cb. Thus, the shank 15*a* is free of contact with the first mounting portion 30C. In a similar manner, the shank 15*a* of the fastener 15 is insertable through the openings 31Db1 and 31Db2 that are radially inward of the projections 31De1 and 31De2 that are radially inward of the second mounting-hole 30Db. Therefore, the movement of the shank 15*a* in the radial direction is restricted by the projections 31De1 and 31De2 and the second through hole 31Db. Thus, the shank 15*a* is free of contact with the second mounting portion 30D.

Although the first mounting portion 30C is surrounded by and in contact with the first damper 31C, the first mounting portion 30C is free of contact with the shank 15*a* of the fastener 15. In addition, since the first damper 31C is interposed between the first mounting portion 30C and the head 15*b* of the fastener 15, the first mounting portion 30C is free of contact with the fastener 15. Although the second mounting portion 30D is surrounded by and in contact with the second damper 31D, the second mounting portion 30D is free of contact with the shank 15*a* of the fastener 15. In addition, since the second damper 31D is interposed between the second mounting portion 30D and the mounting 82, the second mounting portion 30D is free of contact with the mounting 82. The distal end 30Ca1 of the first mounting portion 30C is spaced away from the innermost 31Cca of the first insertion hole 31Cc. The distal end 30Da1 of the second mounting portion 30D is also spaced away from the innermost 31Dca of the second insertion hole 31Dc.

The metal film 32 interposed between the second mounting portion 30D and the mounting 82 electrically connects the mounting 30 to the mounting 82 of the engine 81. Therefore, the housing 2 of the compressor body 1 is electrically connected to the engine 81 via the metal film 32, which serves to ground the motor-driven compressor 103.

Part of the vibration of the housing 2 is transmitted to the first mounting portion 30C. The vibration transmitted to the first mounting portion 30C is further transmitted to the first damper 31C and dampened therein without being transmitted to the fastener 15 which is free of contact with the first mounting portion 30C. The rest of the vibration of the housing 2 is transmitted to the second mounting portion 30D. Part of the vibration of the second mounting portion 30D is transmitted to the second damper 31D via the metal film 32 having a low rigidity and a small thickness and the rest of the vibration is transmitted directly to the second damper 31D. In either case, no vibration is transmitted to the fastener 15 which is free of contact with the second mounting portion 30D. The vibration transmitted to the second damper 31D is dampened therein. Thus, the vibration of the housing 2 is hard to be transmitted to the mounting 82 and hence to the engine 81 and the body of the vehicle via the engine 81. The rest of the structure and the operation of the motor-driven compressor 103 according to the third embodiment is the same as that of the motor-driven compressor 101 according to the first embodiment, and the description of such structure and operation will be omitted.

Thus, the motor-driven compressor 103 of the third embodiment offers substantially the same effects as the motor-driven compressor 101 of the first embodiment. In the motor-driven compressor 103 wherein the first damper 31C and the second damper 31D are mounted to the first mounting portion 30C and the second mounting portion 30D, respectively, the first damper 31C and the second damper 31D may be smaller in size than the counterpart of the first embodiment, and the use of the resin for the damper is reduced, accordingly. Forming the first mounting portion 30C and the second mounting portion 30D of each mounting 30 with the same shape, the first damper 31C and the second damper 31D may also be mounted in the same shape to the first mounting portion 30C and the second mounting portion 30D. Thus, it is not necessary to modify the shape of the dampers 31C, 31D in accordance with the number of mounting portions. It is not necessary to individually manufacture the die for molding the resin dampers 31C and 31D, either. Therefore, the cost for manufacturing the compressor is reduced.

The first damper 31C is fixed at the projections 31Ce1 and 31Ce2 thereof to the first mounting hole 30Cb of the first mounting portion 30C. That is, the first damper 31C is fixed to the first mounting portion 30C in such a way that the projections 31Ce1 and 31Ce2 hold therebetween the first mounting portion 30C. Even if the end of the external thread 15*a*1 of the shank 15*a* of the fastener 15 comes in contact with the projection 31Ce2 in the first mounting hole 30Cb in inserting the shank 15*a* through the first mounting hole 30Cb, the first damper 31C is prevented from being removed from the first mounting hole 30Cb. In a similar manner, the second damper 31D is fixed at the projections 31De1 and 31De2 thereof to the second mounting hole 30Db of the second mounting portion 30D. That is, the second damper 31D is fixed to the second mounting portion 30D in such a way that the projections 31De1 and 31De2 hold therebetween the second mounting portion 30D. Even if the end of the external thread 15*a*1 of the shank 15*a* of the fastener 15 comes in contact with the second damper 31D at a position adjacent to the right opening of the second through hole 31Db or with the projection 31De2 in the second through hole 31Db in inserting the shank 15*a*, which has been already inserted through the first mounting hole 30Cb, through the second mounting hole 30Db, the second damper 31D is prevented from being removed from the second mounting hole 30Db. Therefore, mounting of the motor-driven compressor 103 to the engine 81 is accomplished with efficiency.

Although, in the first through third embodiments, the shank 15*a* of the fastener 15 is free of contact with the dampers 11, 21, 31C and 31D, it is not limited to such structure. The dampers 11, 21, 31C and 31D may be formed so as to come in contact with the periphery of the shank 15*a*. In this case, the fastener 15 and the dampers 11, 21, 31C and 31D are combined with each other thereby to increase the strength of the shank 15*a* in the radial direction thereof.

Although, in the first through third embodiments, each of the projections 11*e*1, 11*e*2, 11*f*1, 11*f*2, 21*e*1, 21*e*2, 31Ce1, 31Ce2, 31De1, 31De2 are formed in an annular shape, it is not limited to such structure. The projection may also be formed in a rectangular shape. The projection may also be formed in divided annular shapes or divided rectangular shapes. Alternatively, the projection may also be formed in a part of annular shape or a part of rectangular shape.

Although, in the first through third embodiments, each of the mounting holes 10Cb, 10Db, 20*b*, 30Cb, 30Db of the mountings 10C, 10D, 20, 30C, 30D has a round shape in cross section, it is not limited to such structure. The mounting holes such as 10Cb, 10Db, 20*b*, 30Cb, 30Db may be formed in a rectangular shape in cross section. The mounting holes such as 10Cb, 10Db, 20*b*, 30Cb, 30Db may be formed with a groove which opens part of the mountings such as 10C, 10D, 20, 30C, 30D.

Although in the first through third embodiments the fastener 15 is made of a metal, it may be made of a resin as in the case of the dampers 11, 21, 31C and 31D. If such a fastener 15 comes in contact with the mountings 10C, 10D, 20, 30C, 30D, the fastener 15 prevents the vibration of the compressor body 1 from being transmitted to the mounting 82 of the engine 81 via the fastener 15.

Although, in the first through third embodiments, the metal films 12, 22, 32 are provided on the outer surfaces 11*a*1, 21*a*1, 31Da1 of the damper 11, 21, 31D, respectively, they are not limited to such structure. The metal films such as 12, 22, 32 may be located in the through holes 11*b*, 21*b*, 31Db, respectively. The metal films such as 12, 22, 32 may also be located inside the dampers 11, 21, 31D.

The metal films 12, 22, 32 of the first through third embodiments for grounding the motor-driven compressors 101, 102, 103, respectively, may be substituted by a metal in any suitable form such as a line, fiber or rod.

In the first through third embodiments, each of the mountings (or mounting portions) 10C, 10D, 20, 30C, 30D and each of the dampers 11, 21, 31C, 31D are used in the motor-driven compressor mounted on the internal combustion engine 81 installed in a vehicle. According to the present invention, however, they are not limited to such structure. Each mounting (or each mounting portion) and each damper may be used in a motor-driven compressor on an electric traction motor installed in a fuel cell powered vehicle or electric vehicle.

The motor-driven compressor of the present invention is not limited to a refrigerant compressor in a refrigeration system, but may be used for various applications. The motor-driven compressor may be any air compressor used in air-suspension system of vehicle, or any pump mounted in the fuel cell powered vehicle for pumping hydrogen or air to a stack.

What is claimed is:

1. A motor-driven compressor mounted on a mounting of a vehicle, comprising:

a compressor body being electrically powered to draw in fluid for compression and to discharge the compressed fluid;

a mounting formed on the compressor body and having a mounting hole;

a damper made of a resin and receiving therein the mounting of the compressor, the damper being interposed between the compressor body and the mounting of the vehicle, the damper having a through hole and an insertion hole that extends perpendicularly to the through hole so as to communicate with the through hole, the insertion hole being formed to extend continuously via one end of a diameter of the through hole beyond the other end of the diameter to receive the same mounting of the compressor; and a fastener inserted through the through hole and the insertion hole of the damper and the mounting hole of the mounting of the compressor for securing the damper to the mounting of the vehicle, wherein a wall of the damper defines the insertion hole, and a gap is formed between the wall of the damper and a distal end of the mounting, and wherein the damper has a projection that engages with the mounting hole of the mounting of the compressor for fixing the mounting of the compressor to the damper.

2. The motor-driven compressor according to claim 1, wherein the mounting hole of the mounting of the compressor is larger than the fastener that is inserted through the mounting hole, the fastener being free of contact with the mounting of the compressor.

3. The motor-driven compressor according to claim 1, further comprising a flexible conductor formed integrally with the damper for electrically connecting the mounting of the compressor and the mounting of the vehicle.

4. The motor-driven compressor according to claim 1, wherein the damper is made of said resin whose bending elastic modulus is not less than 100 MPa and not more than 10000 MPa.

* * * * *